US005820154A

United States Patent [19]

Howe

[11] Patent Number: 5,820,154

[45] Date of Patent: Oct. 13, 1998

[54] SKI CONSTRUCTION

[76] Inventor: John G. Howe, R.F.D. #1, Box 2460, No. Waterford, Me. 04267

[21] Appl. No.: 886,209

[22] Filed: Jul. 1, 1997

Related U.S. Application Data

[60] Provisional application No. 60/045,079 Apr. 29, 1997.

[51] Int. Cl.[6] ..... A63C 5/075

[52] U.S. Cl. ..... 280/602; 280/607; 280/610

[58] Field of Search ..... 280/602, 607, 280/610

[56] References Cited

U.S. PATENT DOCUMENTS 2,995,379 8/1961 Head .
4,405,149 9/1983 Piegay .
4,979,761 12/1990 Rohlin .
5,344,176 9/1994 Trimble .
5,413,371 5/1995 Trimble .

FOREIGN PATENT DOCUMENTS 0104185 5/1987 European Pat. Off. .

*Primary Examiner*—Russell D. Stormer
*Assistant Examiner*—Clovia Hamilton
*Attorney, Agent, or Firm*—Cushman Darby&Cushman IP Group of Pillsbury Madison & Sutro LLP

[57] ABSTRACT

A layer of low density elastomeric material is interposed between upper and lower segments of a ski, the layer and upper segment extending along at least 35% of the length of the lower segment. The elastomeric layer contains at least one insert of high density material disposed in a direction across the width of the ski, the insert being of greater density than the low density elastomeric material to provide torsional rigidity to a ski which otherwise has softened longitudinal flexibility and enhanced vibration damping.

26 Claims, 1 Drawing Sheet

SKI CONSTRUCTION

This application claims benefit of USC Provisional Application No. 60/045,079, filed Apr. 29, 1997.

BACKGROUND OF THE INVENTION

1. Field of the Invention

The present invention relates to an improved ski or snowboard construction wherein materials are combined in such a manner as to enhance performance—especially with regard to ice-holding ability and the reduction of vibration and chattering at high speed.

Although the invention pertains both to skis and snowboards, for convenience of discussion reference will be limited hereinafter to skis, it being understood, however, that the same principles disclosed are applicable to snowboards as well.

2. Prior Art

It is well known that ski performance involves control of the longitudinal flexibility and torsional rigidity of the ski. As a ski passes over uneven terrain, it is desirable that it flex longitudinally. However, to negotiate turns, the ski must have sufficient torsional rigidity so that its edges can carve into snow to cause the ski to turn. It also is known that vibration and shock transmitted to the skier's legs can be reduced by a laminated ski construction wherein one or more of layers, or partial layers of a lamination consists of an elastomeric material. An example is the ski disclosed in U.S. Pat. No. 4,405,149.

In U.S. Pat. Nos. 5,344,176 and 5,413,371, and in published European Application 0104105, elastomeric materials, alone or in combination with solid materials, are secured to the upper surface of a conventional ski in spaced relationship between the ski and its binding. One purpose of such construction is to elevate the skier above the ski to improve the skier's turning leverage. Additionally, the elastomeric material serves to damp vibrations encountered as the skis are used, such damping being achieved without significantly affecting the ski's flexibility. Such "add-on" devices add weight and some stiffness to the ski, and they can interfere with the ski binding's function.

SUMMARY OF THE INVENTION

The present invention provides a high performance ski construction which nevertheless permits increased longitudinal flexibility and greatly enhanced vibration damping, as compared with known skis, without increasing the ski's weight. This is accomplished by forming the ski with upper and lower segments, and providing a thick layer of low density elastomeric material between the two segments, the layer containing at least one insert of substantially non-resilient material extending across the width of the ski which maintains the ski's torsional rigidity. Such a ski construction additionally permits ski bindings to be mounted above the upper surface of the upper segment so as to elevate the skier, thereby reducing boot drag and improving the skier's turning leverage.

BRIEF DESCRIPTION OF THE DRAWINGS

The invention now will be described in greater detail with respect to the accompanying drawing, wherein.

DETAILED DESCRIPTIONS OF PREFERRED EMBODIMENTS OF THE INVENTION

Figure 1:
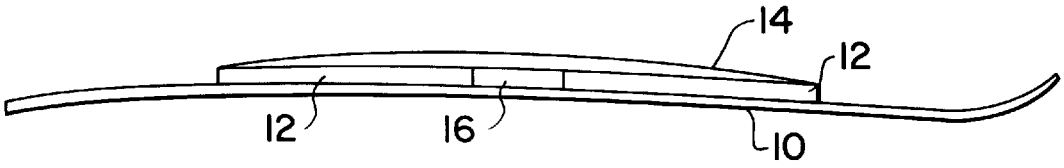
FIG. 1 is a side elevational view of a ski constructed in accordance with the present invention.

The present invention improves ski performance through a unique lamination arrangement which is illustrated in the accompanying FIG. 1 and which now will be described.

A first lower ski segment 10 of conventional construction, but of lighter weight and greater flexibility, is provided with a layer of elastomeric material 12 interposed between lower segment 10 and a second upper ski segment 14. The upper segment 14 is long and strong enough to serve as a surface for securing the bindings which retain the skier's boot and to provide torsional and longitudinal stiffness, as well as vibration control, to lower segment 10. The length of the upper segment 14 and elastomeric layer 12 is selected so as to be between 35 and 80% of the overall length of the lower ski segment 10. To achieve the desired characteristics, the material used as layer 12 preferably is an elastomeric foam having a density between 5 and 35 pounds per cubic foot, the most desirable density being approximately 25 pounds per cubic foot. The thickness of layer 12 preferably is in the range of 0.100–0.400".

Through appropriate selection of the thickness of segment 14 a division of ski stiffness can be achieved between the upper segment 14 and lower segment 10. That division of stiffness preferably has a ratio of approximately 10:90 to as much as 75:25 (top to bottom). By so arranging the upper and lower segments to be significantly independent of one another, a substantial damping of vibration and shock forces to the skier's legs occurs thereby making the ski more comfortable and precise to use, especially on icy surfaces. Such damping typically is from 3 to 3½ times greater than in conventional skis or 2½ to 3 times greater than conventional skis used in combination with so-called damping plates such as described in U.S. Pat. No. 5,413,371 or European Application 0104185. At the same time, the longitudinal flexibility of the compound ski is softer than conventional skis so as to permit the ski to better conform to the contour of the terrain over which the ski passes. This is because the enhanced damping and extended control provided by the upper ski segment 14 combine to force the extremities of the ski to hold on the ice with extra tenacity.

As stated previously, it is extremely important that the torsional characteristics of the ski be controlled so that proper edging can be achieved for negotiating turns. In order to retain the desired torsional characteristics of the ski, at least one substantially non-resilient, high density insert 16 is embedded in the low density elastomeric layer 12, insert 16 extending over the full width of layer 12. Such an insert preferably is made of hard rubber having a density of greater than 40 pounds per cubic foot.

If one insert 16 is used, it preferably is positioned within layer 12 between the locations of the toe and heel pieces of the bindings. When two spaced inserts are incorporated within layer 12, they preferably are positioned below the binding's toe and heel pieces, respectively. It has been found that with one or a multiple of inserts 16, a ski can be produced having outstanding damping characteristics, combined with softened longitudinal flexibility, while maintaining the desired degree of torsional rigidity.

The torsional characteristics of the ski also can be established, if desired, by varying the compressibility of the elastomeric foam layer 12 transversely to the longitudinal axis of the ski. More particularly, a higher density foam, having a density of at least 50 pounds per cubic foot, can be employed on the inside edge of layer 12. i.e., that portion of layer 12 closest to the inside edge of the ski. Of course, this alternative is not applicable to a snowboard.

Torsional characteristics additionally can be achieved by varying the density of the elastomeric material of layer 12 in the direction of the ski's longitudinal axis. In such a case, the material is selected so as to be of higher density at its center than at the ends of layer 12. The highest density area again is greater than 40 pounds per cubic foot, preferably approximately 60.

Figure 2:
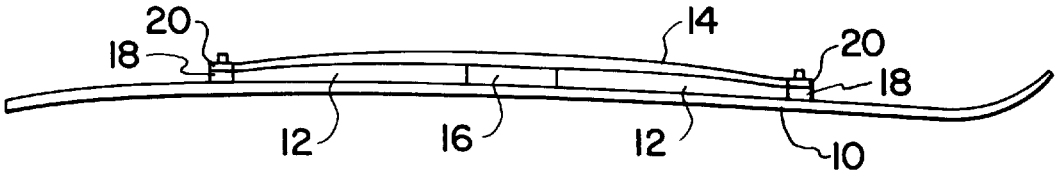
FIG. 2 is a side elevational view of a further embodiment of a ski constructed in accordance with the present invention.

In the embodiments discussed above, the ski's characteristics are fixed during manufacture. However, it also is possible to provide an adjustability feature to permit the skier to vary the stiffness and damping of the ski during use. This is accomplished (FIG. 2) by the use of a conventional friction plate 18 at one or both ends of the upper ski segment 14. The friction plate is secured to the lower ski segment 10 and rests on the upper surface of upper segment 14. An adjusting knob 20 bears on the plate to clamp layer 14 to lower segment 10 to a degree dependent on the adjustment of the knob. By this arrangement, the energy absorption contributed by layer 12 can be altered thereby varying the overall stiffness characteristic of the composite ski.

The invention just described provides a ski construction having a high degree of damping and soft feel without the loss of torsional rigidity. The substantial thickness of combined layers 12 and 14 also results in the elevation of a skier's boot which allows improved edge control and reduced boot drag during turns. Since the upper and lower segments 14 and 10 of the ski can flex independently and have high damping, the ski flex through the boot mounting area thereby permits very short skis to be made while maintaining an adequate boot mounting capability.

An additional advantage of this invention is that the increased thickness of the total ski allows the use of a much narrower lower ski (segment 10). This is because the boot and binding are displaced upwardly high enough to allow high edge angles of the ski without encountering boot or binding drag. This reduction in width further enhances the performance of the composite ski on ice because less twisting torque is required to place the ski on its edge.

What is claimed is:

1. A ski construction comprising:

a lower elongated ski segment having a width defined by spaced side edges extending between opposite ends of the lower segment;

an upper elongated ski segment overlying said lower segment, said upper segment having a width substantially corresponding to the width of the lower segment and terminating at ends located between the ends of the lower segment; and an elongated layer of elastomeric material having a width substantially corresponding to the width of the lower and upper segments, said layer being attached to and separating said lower and upper segments and extending along at least 35% of the length of the lower segment, said layer including at least one insert of material disposed within said layer in spaced relationship from opposite ends of the layer, said insert extending across the width of the layer to side edges thereof, said insert being of greater density than said elastomeric layer so as to be substantially non-resilient thereby providing torsional rigidity between the upper and lower ski segments.

2. A ski construction according to claim 1, wherein said elastomeric layer covers a central portion of the lower ski segment.

3. A ski construction according to claim 1, wherein said elastomeric layer extends up to 80% of the length of the upper surface of the lower ski segment.

4. A ski construction according to claim 2, wherein said elastomeric layer extends up to 80% of the length of the upper surface of the lower ski segment.

5. A ski construction according to claim 1, wherein said elastomeric layer is a foam having a density substantially in the range of 5 to 30 pounds per cubic foot.

6. A ski construction according to claim 1, wherein said elastomeric layer has a thickness substantially in the range of 0.100–0.400".

7. A ski construction according to claim 5, wherein said elastomeric layer covers a central portion of the lower ski segment.

8. A ski construction according to claim 5, wherein said elastomeric layer extends up to 80% of the length of the upper surface of the lower ski segment.

9. A ski construction according to claim 8, wherein said elastomeric layer covers a central portion of the lower ski segment.

10. A ski construction according to claim 6, wherein said elastomeric layer covers a central portion of the lower ski segment.

11. A ski construction according to claim 6, wherein said elastomeric layer extends up to 80% of the length of the upper surface of the lower ski segment.

12. A ski construction according to claim 11, wherein said elastomeric layer is a foam having a density substantially in the range of 5 to 30 pounds per cubic foot.

13. A ski construction according to claim 1, wherein said elastomeric layer covers a central portion of the lower ski segment and the insert is located adjacent to said central portion.

14. A ski construction according to claim 13, wherein said elastomeric layer extends up to 80% of the length of the upper surface of the lower ski segment.

15. A ski construction according to claim 13, wherein said elastomeric layer is a foam having a density substantially in the range of 5 to 30 pounds per cubic foot.

16. A ski construction according to claim 13, wherein said elastomeric layer has a thickness substantially in the range of 0.100–0.400".

17. A ski construction according to claim 16, wherein said elastomeric layer is a foam having a density substantially in the range of 5 to 30 pounds per cubic foot.

18. A ski construction according to claim 1, including at least two spaced inserts.

19. A ski construction according to claim 1, wherein said insert is a strip of material having a density greater than 40 pounds per cubic foot.

20. A ski construction according to claim 18, wherein said inserts are strips of material having a density greater than 40 pounds per cubic foot.

21. A ski construction according to claim 1, wherein said insert is formed by the density of the elastomeric layer being higher on one side of the ski than on the other.

22. A ski construction according to claim 21, wherein the higher density portion of the layer has a density of at least 50 pounds per cubic foot and wherein the density of the layer on the other side of the ski is less than 35 pounds per cubic foot.

23. A ski construction according to claim 1, wherein said insert is formed by the density of the elastomeric layer being greater at a central portion thereof than at the ends of the layer.

24. A ski construction according to claim 23, wherein the higher density portion of the layer has a density of at least 50 pounds per cubic foot and wherein the density of the layer on the ends of the layer is less than 35 pounds per cubic foot.

25. A ski construction according to claim 1, further comprising an adjustable friction plate connected between an upper surface of the lower ski segment and an upper surface of the upper ski segment.

26. A ski construction according to claim 1, wherein said insert is disposed substantially midway between said opposite ends of the elastomeric layer.

* * * * *